US007579934B2

(12) United States Patent
Müller

(10) Patent No.: US 7,579,934 B2
(45) Date of Patent: Aug. 25, 2009

(54) POWER BREAKER AND ARRANGEMENT FOR SWITCHING ELECTRICAL CURRENTS

(75) Inventor: Heinrich Müller, Tuttlingen (DE)

(73) Assignee: Marquardt GmbH, Rietheim-Weilheim (DE)

( * ) Notice: Subject to any disclaimer, the term of this patent is extended or adjusted under 35 U.S.C. 154(b) by 457 days.

(21) Appl. No.: 11/260,669

(22) Filed: Oct. 26, 2005

(65) Prior Publication Data

US 2007/0046405 A1 Mar. 1, 2007

(30) Foreign Application Priority Data

Aug. 24, 2005 (DE) ..... 10 2005 040 246

(51) Int. Cl.
*H01H 51/22* (2006.01)
*H01H 67/00* (2006.01)
*H01H 13/04* (2006.01)

(52) U.S. Cl. ..... 335/78; 335/106; 335/107; 335/202

(58) Field of Classification Search ..... 335/78–86, 335/151–154, 205–207, 106, 107, 202
See application file for complete search history.

(56) References Cited

U.S. PATENT DOCUMENTS 3,061,696 A * 10/1962 Peek, Jr. ..... 335/154
4,023,882 A * 5/1977 Pettersson ..... 439/426
4,227,162 A * 10/1980 Fujita et al. ..... 335/202
4,731,597 A 3/1988 Hinrichs
7,157,994 B2 * 1/2007 Minowa et al. ..... 335/84

FOREIGN PATENT DOCUMENTS

| | | |
|---|---|---|
| DE | 1 989 938 | 7/1968 |
| DE | 1 639 290 | 2/1971 |
| EP | 0 206 781 | 12/1986 |
| EP | 0 222 243 | 5/1987 |
| JP | 09-35606 | 2/1997 |

OTHER PUBLICATIONS

Fachbuch, "Fachkunde Elektrotechnik", 24 Auflage, 2004, Seite 110, Bild 1, pp. 109-110.

* cited by examiner

*Primary Examiner*—Ramon M Barrera
(74) *Attorney, Agent, or Firm*—Burr & Brown

(57) ABSTRACT

The invention relates to a power breaker for switching electrical loads having a parallelepipedal shape having four longitudinal sides lying in the longitudinal direction (LQ) of the parallelepiped, a first transverse side and an opposing second transverse side, an electromagnetic coil having a longitudinal axis (LS), an input connection, an output connection, and a moving contact path that is electrically connected to the input connection or the output connection. The invention also relates to power supply assembly arrangement for switching an electrical current between an external power supply line and at least one load where the moving contact path and the coil are arranged longitudinally parallel to one another in the longitudinal direction (LQ) of the parallelepipedal shape.

26 Claims, 8 Drawing Sheets

POWER BREAKER AND ARRANGEMENT FOR SWITCHING ELECTRICAL CURRENTS

This application claims the benefit under 35 USC §119(a)-(d) of German Application No. 10 2005 040 246.1, filed Aug. 24, 2005, the entirety of which is incorporated herein by reference.

FIELD OF THE INVENTION

The invention relates to a power breaker for switching electrical voltage for an electrical device or load, and also relates to a power supply assembly arrangement for switching an electrical current between an external power supply and at least one electrical device or load.

For example, a power breaker in accordance with the present invention can be used as a power supply assembly arrangement for an electrical device, such as a heater, a lawnmower, an electric vehicle or the like.

BACKGROUND OF THE INVENTION

The technical book "Fachkunde Elektrotechnik", [specialist knowledge on electrical engineering], 24th edition, 2004, page 110, FIG. 1 discloses a power breaker in relay form for switching electrical loads, the power breaker having a parallelepipedal shape comprising four longitudinal sides, a first transverse side, an opposing second transverse side, an electromagnetic coil having its longitudinal axis parallel to the longitudinal axis of the power breaker, an input connection, an output connection and a moving contact path, which is electrically connected to the input connection or the output connection. While, such power breakers may have a compact design in terms of a space-saving arrangement of their components, but they are not particularly well suited for the laying or supplying of power lines and/or designing switching electrical currents comprising two or more power breakers.

SUMMARY OF THE INVENTION

The invention provides a clear and space-saving design for a power breaker or a power supply assembly arrangement for switching electrical currents that makes it possible for the power lines to be laid or supplied in a clear manner.

The goal of laying or supplying power lines in a clear manner is achieved in a power breaker according to the present invention, which is configured in a parallelepipedal shape having four longitudinal sides, two opposing transverse sides, an electromagnetic coil having its longitudinal axis parallel to the longitudinal axis of the power breaker, an input connection, an output connection, and a moving contact path arranged parallel to the electromagnetic coil that is electrically connected to either the input connection or the output connection.

The goal is also achieved in a power supply arrangement for switching an electrical current between an external power supply and at least one load by configuring the power breaker in a power supply arrangement with the external power supply electrically connected to at least one of the input connections of the power breaker in the power supply assembly arrangement and the at least one load electrically connected to at least one of the output connections of the power breaker in the power supply assembly arrangement by configuring the moving contact path and the coil such that they are longitudinally parallel to one another in the longitudinal direction of the parallelepipedal shape. This results, overall, in a narrow, elongate design, which makes it possible for the power lines to be laid and supplied in a compact and clear manner.

One embodiment of the invention also comprises a parallelepipedal shaped housing that protects the power breaker against environmental influences and completely insulates the power breaker from its environment.

According to another embodiment of the invention, the coil and the moving contact path are arranged longitudinally parallel one on top of the other along the longitudinal axis of the parallelepipedal shape. This arrangement achieves a particularly narrow shape, which has a small base surface.

Another aspect of the invention provides for the input connection and the output connection to be arranged on opposing sides of the parallelepipedal shape. This connection arrangement allows the relatively thick lines for the current to be switched so as to be distributed on two sides of the power breaker. In this arrangement, the entire area of one side is thus available for the connection of an incoming line and the connection of an outgoing line, and the incoming line and the outgoing line can be associated in a clear manner with different sides of the power breaker.

In a preferred embodiment, the input connection and the output connection are arranged on the transverse sides. This is particularly advantageous since these transverse sides have the greatest distance from one another.

Furthermore, an embodiment of the present invention provides for the power breaker to be arranged on a printed circuit board (PCB). This facilitates a simple PCB layout, for example, for the tracks or traces for the control lines for the coil or the signal lines for a sensor on the power breaker PCB.

Another aspect of the invention provides for the power breaker to be equipped with an insulating link, which acts as a carrier and a mount for the moving contact path, holding the moving contact path at a distance from the printed circuit board. This feature makes it possible to realize a simple and cost-effective design of the power breaker.

Furthermore, another-embodiment of the invention provides for the insulating link to be fixed to the printed circuit board. The insulating link represents a central component of the power breaker and, by fixing the link to the PCB, the insulating link can be subjected to particularly high loads.

Another aspect of the present invention provides for contact with the coil via conductor tracks arranged on the printed circuit board. This arrangement makes it possible to make contact with the power breaker in a quick and fault-free manner.

Another aspect of the present invention provides for the moving contact path to be aligned with its broad side essentially parallel to the printed circuit board. This alignment allows for a simple articulation of an actuator for moving the contact path. This is particularly true in the case of a contact path lying above the coil and, when used in a transparent housing, the moving contact path can be used for a self-clarifying understanding of the operation of the power breaker since the power breaker is similar in plan view to a circuit diagram.

Furthermore, another aspect of the invention provides for the moving contact path to have a length, which approximately corresponds to the length of the parallelepipedal shape of the power breaker, between a mount and a contact. Owing to the relatively long length of the moving contact path, only a slight bend in the contact path is required for a switching movement, and thus thick contact paths, which are suitable for high power, can also be moved by means of relatively small coils.

The invention also provides for the coil to form part of an approximately parallelepipedal electromagnet, which is oriented vertically and by means of which, with the interconnection of an actuating lever and a plunger, the moving contact path can be actuated in the manner of a contact lug. As a result, a power breaker according to the invention can be constructed using few components.

Finally, the invention provides for the output connection, the input connection and the moving contact path to be in the form of a stamped, bent part, with the moving contact path being integral to the output connection or the input connection. As a result, the number of individual parts can be reduced and, at the same time, soldered joints, which are susceptible to breakage can be avoided.

In another embodiment of the present invention, the power breaker is used advantageously in a power supply assembly arrangement for switching an electrical current for an electrical device with the external power supply line being electrically connected to at least one of the input connections, and the load being electrically connected to at least one of the output connections. As a result, it is possible for the power lines to be laid or supplied in a clear manner and for the overall design to be clear and space-saving.

Another embodiment of the present invention provides for a power supply assembly arrangement having at least one terminal block in the parallelepipedal shape of the power breaker, and including an input connection and the output connection. Where the terminal block input connection and output connection are directly electrically connected to each other, the input connection, output connection and electrical connection (EV) can be formed as an integral stamped, bent part. Such a terminal block is of simple design and can be added to the arrangement in modular fashion, primarily for the arrangement of an additional non-switchable electrical feed line to the load.

Furthermore, the invention provides for the power breakers and/or the terminal blocks to be arranged next to one another and/or one on top of the other in the form of a grid, said power breakers and/or terminal blocks in this case lying parallel to one another in the longitudinal direction of their parallelepipedal shape. A module comprising power breakers and/or terminal blocks is compact and provides optimum accessibility for the purpose of making contact with the power breakers and/or terminal blocks.

In a preferred embodiment, the modular arrangement is accommodated in a housing, from which the input connections and the output connections protrude. This allows for simple contact-making and at the same time protects the modular arrangement from environmental influences.

Another embodiment of the present invention provides for the output connection to be in the form of a plugging lug, and an output connection current conductor, to be configured with a latching plugging connection. This allows for simple assembly of the output connection arrangement in the electrical device.

Another embodiment of the present invention provides for the input connection to be in the form of a contact plate having a hole, and a current conductor, associated with the input connection, having a bore, which can be fixed to the input connection by means of a screw. This provides a connection which is safeguarded against tensile loads and is suitable, in addition, for supplying higher currents.

Another embodiment of the present invention provides for contact to be made with two or more adjacent output connections by means of a multipole plug. This makes possible rapid connection of the output connections.

Finally, another embodiment of the present invention provides each power breaker and/or terminal block with a dedicated output connection and for two or more power breakers and/or terminal blocks to be supplied with a common input connection, which is in the form of an integral stamped, bent part, that is fixed to the printed circuit board. This configuration results in the simplification of the power supply of a large number of loads since only one power supply line is required for a group of power breakers and/or terminal blocks, which act as a distribution board.

BRIEF DESCRIPTION OF THE DRAWINGS

Further details of the invention will be described in the drawing with reference to schematically illustrated exemplary embodiments.

DETAILED DESCRIPTION OF THE INVENTION

Figure 1A:
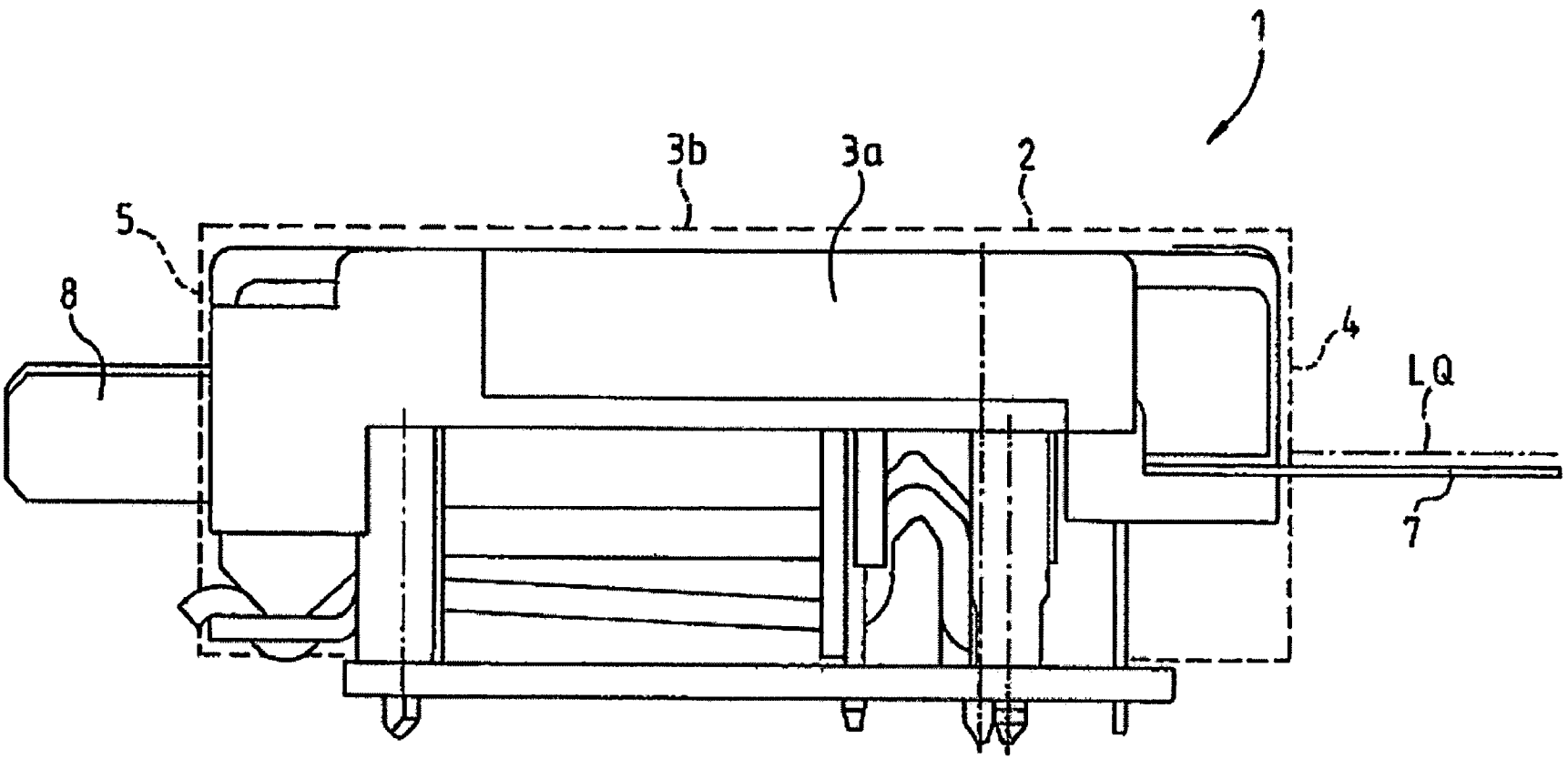
FIG. 1*a* shows a side view of a power breaker.

FIG. 1*a* illustrates a side view of a power breaker 1. The power breaker 1 has a parallelepipedal shape 2. The parallelepipedal shape 2 is delimited by four longitudinal sides 3*a* to 3*d* lying in a longitudinal direction LQ of the parallelepipedal shape 2, a first transverse side 4 and a second transverse side 5 (cf. also FIG. 1*b*). The power breaker 1 comprises an electromagnetic coil 6 having a longitudinal axis LS, which is aligned parallel to the longitudinal direction LQ of the parallelepiped 2. An input connection 7 is arranged on the first transverse side 4 of the power breaker 1, an output connection 8 lying opposite said input connection 7 on the opposing second transverse side 5 of the power breaker 1.

Figure 1B:
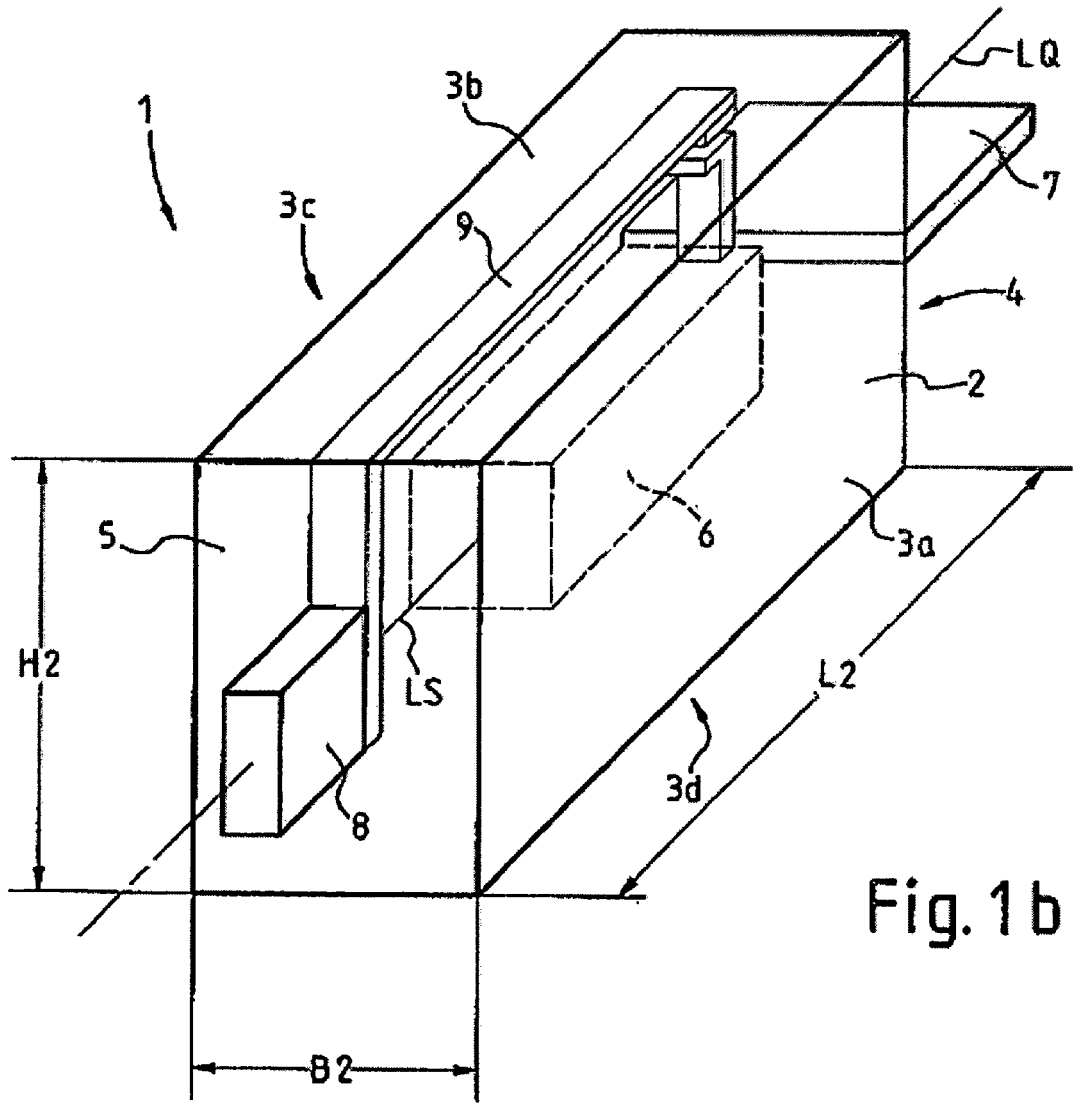
FIG. 1*b* shows a schematic, perspective view of the power breaker illustrated in FIG. 1*a;*
Figure 2:
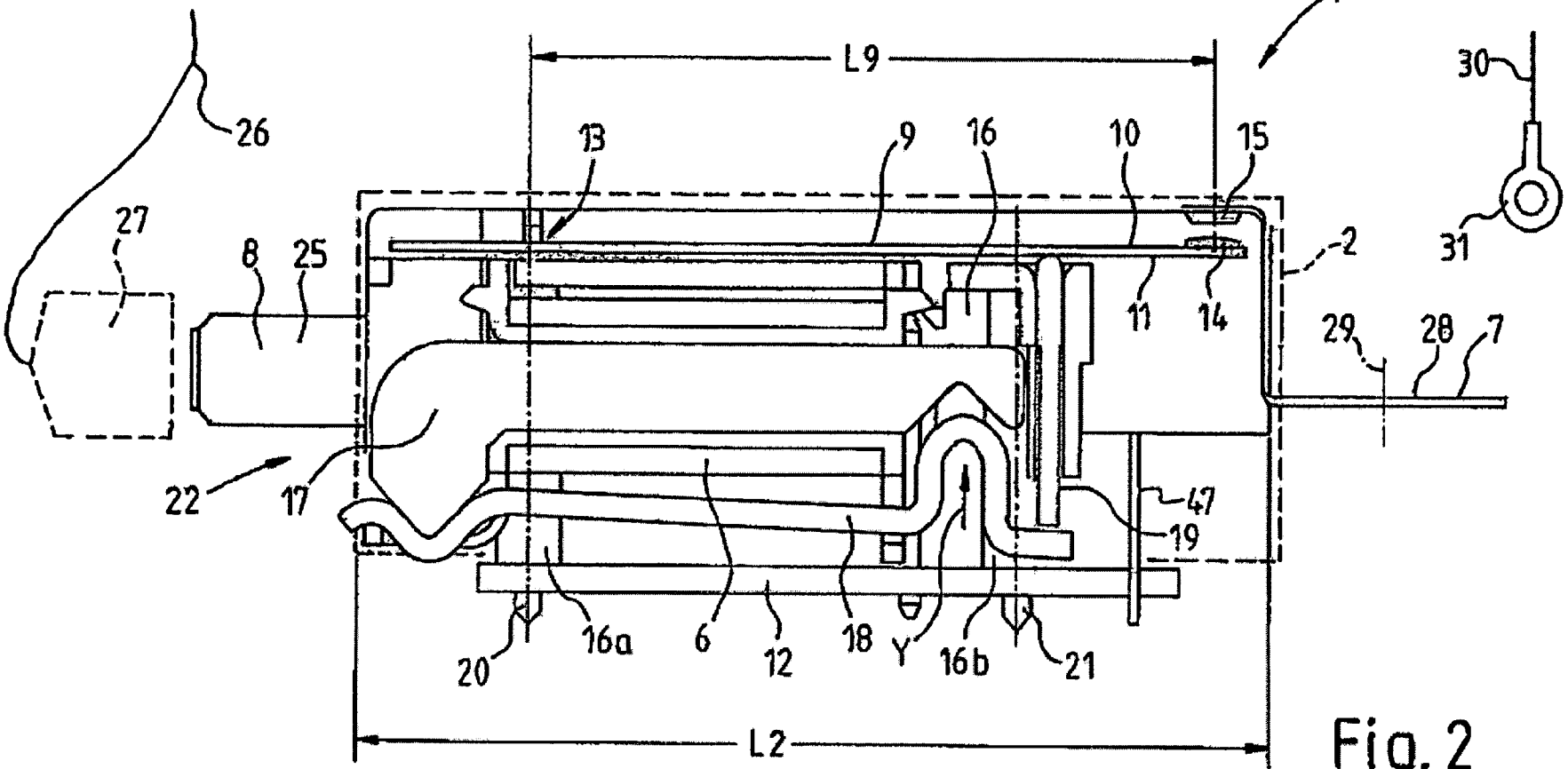
FIG. 2 shows a sectioned side view of the power breaker illustrated in FIG. 1*a;*

As shown in FIG. 1*b*, output connection 8 is formed integrally with a moving contact path 9. As shown in FIG. 2, a moving contact path 9 is aligned with opposing broad sides 10, 11 parallel to the longitudinal side 3*b* of the parallelepipedal shape 2 (see FIG. 1*a*) or parallel to a printed circuit board 12 (cf. also FIG. 2). The moving contact path 9 has a mount 13 and a contact 14. In a connected position (not illustrated) of the power breaker 1, the contact 14 touches a contact 15, which is formed on the input connection 7. The moving contact path 9 has a length L9, which corresponds to more than 50% of a length L2 of the parallelepipedal shape 2 of the power breaker 1, between the mount 13 and the contact 14. The power breaker 1 is fixed to the printed circuit board 12 by means of an insulating link 16. The insulating link 16 acts as a carrier for the electromagnetic coil 6, for its coil core 17, for an actuating lever 18 and for a plunger 19. Furthermore, the input connection 7, the output connection 8 and the moving contact path 9 are fixed to the insulating link 16. A housing (not illustrated) which may be provided is held by the insulating link 16 in a frictional and/or interlocking manner. The insulating link 16 has pins 20, 21 at link feet 16*a*, 16*b*, with the insulating link 16 being held in bores in the printed circuit board 12 via said pins 20, 21. FIG. 2 illustrates the power breaker 1 in an unconnected or open position. An electromagnet 22, which essentially comprises the electromagnetic coil 6 and the coil core 17, is currentless in this position. The application of a corresponding switching voltage to the electromagnet 22 causes the actuating lever 18 to be drawn in an arrow direction y towards the coil core 17 and, in the process, the plunger 19 guided in the carrier likewise shifts upwards in the arrow direction y. The plunger 19 in turn lifts the contact path 9 and bends it with its contact 14 towards the contact 15. The contact path 9 thus has the function of a contact lug. Together with the output connection 8, the contact path 9 is in the form of an integral stamped, bent part. The output connection 8 itself is in the form of a plugging lug 25, with which contact can be made by a current conductor 26 by means of a latching plugging connection 27. The input connection 7 is in the form of a contact plate 28 having a hole 29 and makes it possible to fix a current conductor 30 via an eyelet 31 by means of a screw (not illustrated). The moving contact path 9, beneath which the electromagnet 22 is arranged upright, extends in the longitudinal direction LQ of the parallelepipedal shape 2 of the power breaker 1 between the two connections 7, 8. Corresponding to the schematic of FIG. 1*b*, in a preferred embodiment the following is true for the parallelepipedal shape 2 of the power breaker 1: L2>H2>B2. The power breaker 1 is thus arranged upright if said power breaker rests on a broad side 3*d*.

Figure 3:
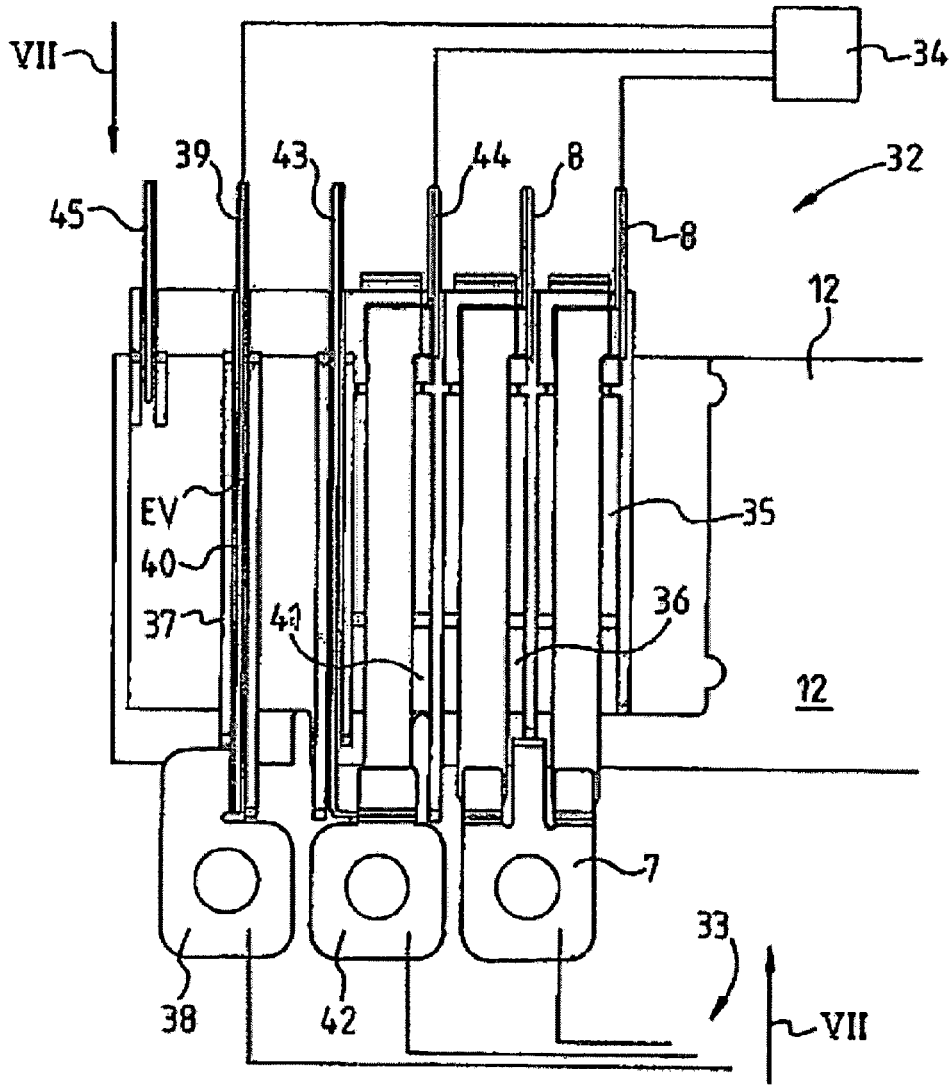
FIG. 3 shows a plan view of an arrangement having power breakers and terminal blocks.

FIG. 3 illustrates a plan view of an arrangement 32 for switching an electrical current between an external power supply line 33 and at least one load 34. The arrangement 32 is envisaged for installation in a power supply assembly (not illustrated) of an electrical device (not illustrated). The power supply assembly arrangement comprises two power breakers 35 and 36, which largely correspond to the power breaker illustrated in FIGS. 1*a* to 2 in terms of their design and their operation. The two power breakers 35, 36 have a common input connection 7, which is fixed on the printed circuit board 12 by means of a foot 47 (see FIG. 2), and isolated output connections 8. Furthermore, the power supply assembly arrangement 32 includes a terminal block 37 having an input connection 38 and an output connection 39, which, together with an electrical connection EV (arranged upright), are in the form of an integral stamped, bent part 40. The terminal block 37, which has essentially the parallelepipedal shape of the power breaker 35, 36, is used, for example, for passing through a grounding line for the power supply assembly arrangement 32. A further power breaker 41, which also has the function of a terminal block, is arranged between the terminal block 37 and the power breaker 36. An input connection 42 of the power breaker 41 is in direct, uninterrupted connection with an output connection 43, on the one hand, and in a switchable connection with an output connection 44, on the other hand. The three power breakers 35, 36, 41 and the terminal block 37 are arranged on a common printed circuit board 12. One embodiment (not illustrated) provides for the power supply assembly arrangement to be accommodated in a housing, in which case only the input connections 7, 38, 42 and the output connections 8, 39, 43, 44 protrude from the housing. The power supply assembly arrangement 32 shows yet another output connection 45, which, however, is not associated with an input connection.

Figure 4:
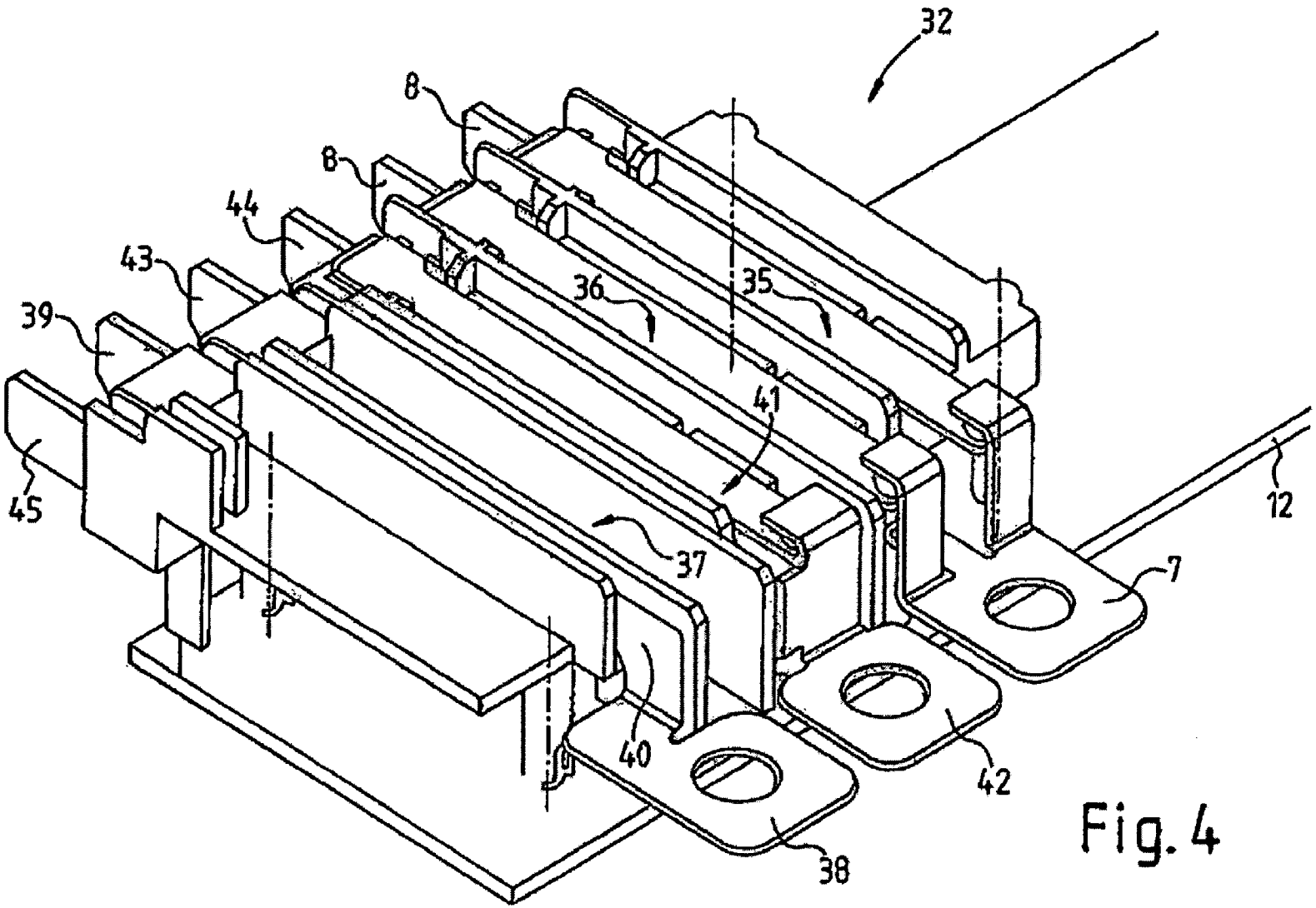
FIGS. 4 and 5 show perspective views of the arrangement shown in FIG. 3.
Figure 5:
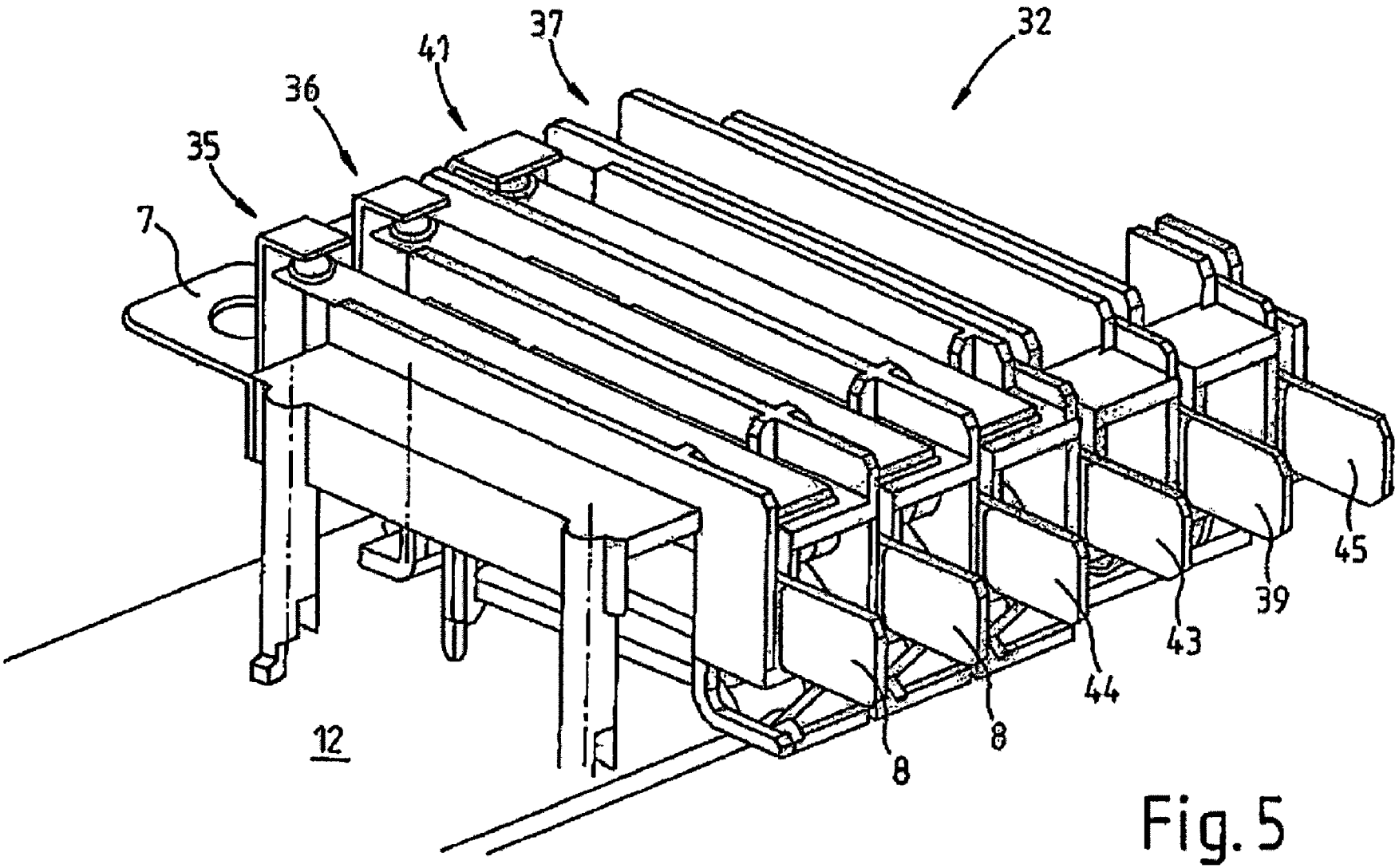

FIGS. 4 and 5 depict perspective views relating to the power supply assembly arrangement 32 illustrated in FIG. 3. Reference is made to the description relating to FIG. 3.

Figure 6:
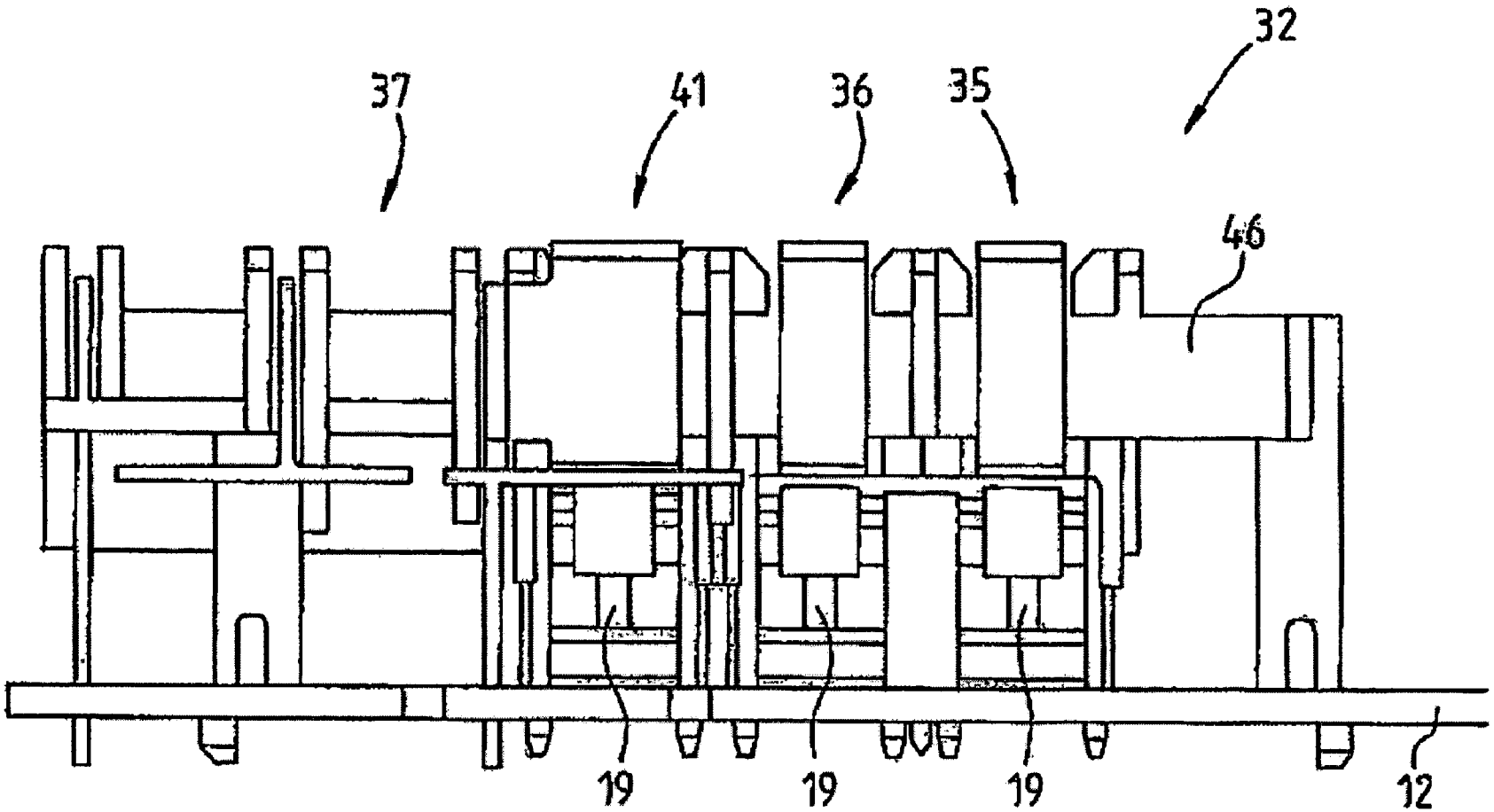
FIG. 6 shows the arrangement known from FIG. 3 from an arrow direction VI.

FIG. 6 illustrates the power supply assembly arrangement 32 shown in FIG. 3 from an arrow direction VI. In this view, plungers 19 of the power breakers 35, 36 and 41 can be seen. The individual components 35, 36, 37 and 41 of the arrangement 32 are additionally connected to the printed circuit board 12 via a transverse carrier 46.

Figure 7:
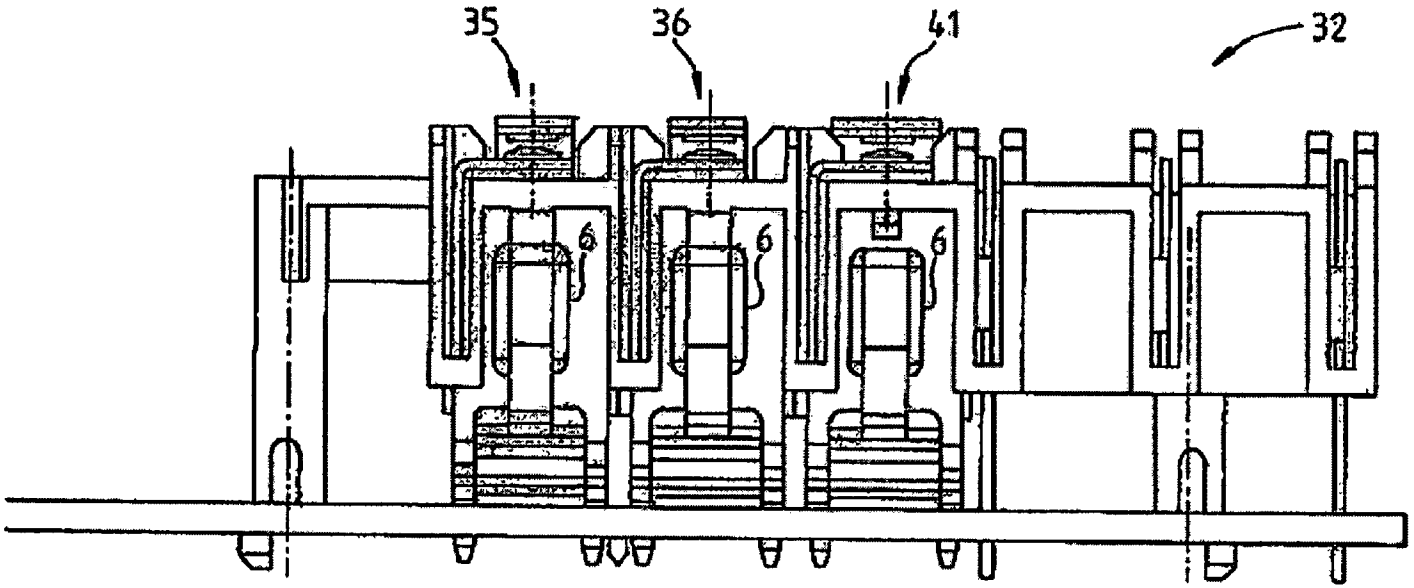
FIG. 7 shows the arrangement known from FIG. 3 from an arrow direction VII.

FIG. 7 illustrates the power supply assembly arrangement 32 shown in FIG. 3 from an arrow direction VII. In this illustration, the coils 6 of the power breakers 35, 36 and 41 can be seen.

Figure 8:
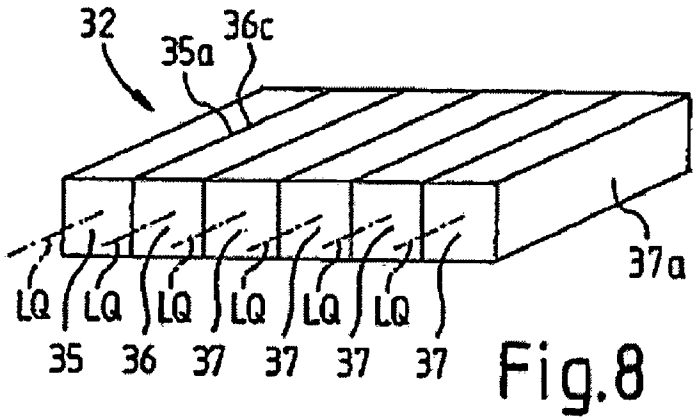

FIG. 8 illustrates a schematic and perspective view of a power supply assembly arrangement 32, which comprises adjacent power breakers 35, 36 and terminal blocks 37, which lie parallel to one another with their longitudinal directions LQ. The power breakers 35 and 36 bear against one another, for example, with congruent longitudinal sides 35*a* and 36*c*.

Figure 9:
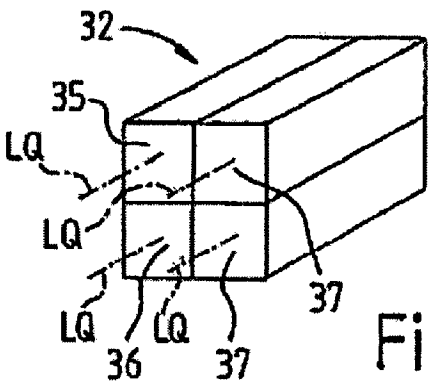
FIGS. 8 and 9 show two schematically illustrated arrangements according to the invention.

FIG. 9 illustrates a schematic and perspective view of a further power supply assembly arrangement 32, which comprises power breakers 35, 36, which are arranged next to one another and one on top of the other, and terminal blocks 37, which lie parallel to one another in their longitudinal direction LQ.

The invention is not restricted to exemplary embodiments illustrated or described. Rather, it comprises developments of the invention within the scope of the patent claims.

LIST OF REFERENCES

1 Power breaker
2 Parallelepipedal shape
3*a* to 3*d* Longitudinal side of 2
4 First transverse side of 2
5 Second transverse side of 2
6 Electrical coil
7 Input connection
8 Output connection
9 Moving contact path
10, 11 Broad side of 9
12 Printed circuit board
13 Mount on 9
14 Contact on 9
15 Contact on 7
16 Insulating link/carrier
16*a*, 16*b* Link foot
17 Coil core
18 Actuating lever
19 Plunger
20, 21 Pin on 16*a* or 16*b*
22 Electromagnet
25 Plugging lug
26 Current conductor
27 Latching plugging connection on 26
28 Contact plate
29 Hole in 28
30 Current conductor
31 Eyelet on 30
32 Arrangement
33 External power supply line
34 Load
35, 36 Power breaker
37 Terminal block
38 Input connection on 37
39 Output connection on 37
40 Integral stamped, bent part comprising 38 and 39
41 Power breaker
42 Input connection of 41
43 Output connection of 41
44 Output connection of 41
45 Output connection
46 Transverse carrier
47 Foot
EV Electrical connection between 38 and 39
B2 Width of 2
H2 Height of 2
L2 Length of 2
LQ Longitudinal direction of 2
LS Longitudinal axis of the coil L9 Length of 9 or distance between 13 and 14

The invention claimed is:

1. A power supply assembly for an electrical device comprising:

at least one power breaker comprising:

a parallelepipedal shape having four longitudinal sides lying in the longitudinal direction (LQ) of said parallelepipedal shape, a first transverse side and an opposing second transverse side, an electromagnetic coil having a longitudinal axis (LS), an input connection, an output connection, a moving contact path, which is electrically connected to one of said input connection and said output connection, wherein said moving contact path and said coil are arranged longitudinally parallel to one another in the longitudinal direction (LQ) of said parallelepipedal shape; and at least one terminal block having an input connection and an output connection, wherein said terminal block has said parallelepipedal shape of said power breaker and said input connection and said output connection are directly electrically connected to one another, wherein said power breaker switches an electrical current between an external power supply line and at least one load, said external power supply line being electrically connected to said input connection of said at least one power breaker and said load being electrically connected to said output connection of said at least one power breaker.

2. A power supply assembly according to claim 1, wherein said parallelepipedal shape of said at least one power breaker further comprises a housing.

3. A power supply assembly according to claim 1, wherein said coil and said moving contact path are arranged longitudinally parallel one on top of the other.

4. A power supply assembly according to claim 1, wherein said input connection and said output connection of said at least one power breaker are arranged on opposing sides of said parallelepipedal shape of said at least one power breaker.

5. A power supply assembly according to claim 1, wherein said input connection of said at least one power breaker is arranged on said first transverse side of said at least one power breaker.

6. A power supply assembly according to claim 1, wherein said output connection of said at least one power breaker is arranged on said second transverse side of said at least one power breaker.

7. A power supply assembly according to claim 1, wherein said at least one power breaker is arranged on a printed circuit board.

8. A power supply assembly according to claim 7, wherein said at least one power breaker further comprises an insulating link, which acts as at least one of a carrier and a mount for said moving contact path, and which holds said moving contact path at a distance from said printed circuit board.

9. A power supply assembly according to claim 8, wherein said insulating link is fixed to said printed circuit board.

10. A power supply assembly according to claim 7, wherein contact is made with said coil via conductor tracks arranged on said printed circuit board.

11. A power supply assembly according to claim 7, wherein a broad side of said moving contact path is aligned essentially parallel to said printed circuit board.

12. A power supply assembly according to claim 1, wherein said moving contact path has a length (L9), which approximately corresponds to a length (L2) of said parallelepipedal shape of said power breaker, between a mount and a contact.

13. A power supply assembly according to claim 1, wherein said coil is part of an approximately parallelepipedal electromagnet, which is arranged upright and actuates said moving contact path in the manner of a contact lug with the interconnection of an actuating lever and a plunger.

14. A power supply assembly according to claim 1, wherein said output connection of said at least one power breaker, said input connection of said at least one power breaker and said moving contact path are in the form of a stamped, bent part, with said moving contact path being arranged integral to one of said output connection and said input connection.

15. A power supply assembly according to claim 1, wherein said input connection of said at least one terminal block, said output connection of said at least one terminal block and an electrical connection (EV) are formed as an integral stamped, bent part.

16. A power supply assembly according to claim 15, wherein a plurality of said power breakers are arranged next to one another and/or one on top of the other, with said power breakers lying parallel to one another in the longitudinal direction (LQ) of their parallelepipedal shape.

17. A power supply assembly according to claim 15, wherein a plurality of terminal blocks are arranged next to one another and/or one on top of the other, with said terminal blocks lying parallel to one another in the longitudinal direction (LQ) of their parallelepipedal shape.

18. A power supply assembly according to claim 1, further comprising a housing from which said input connections and said output connections protrude.

19. A power supply assembly according to claim 15, wherein one of said at least one power breaker and two of said terminal blocks form a contact module for alternating current.

20. A power supply assembly according to claim 15, wherein one of said at least one power breaker and said terminal block form a contact module for direct current.

21. A power supply assembly according to claim 15, wherein at least two or more of said power breakers and said terminal blocks have a dedicated output connection and a common input connection, which is in the form of an integral stamped, bent part that is fixed to a printed circuit board by means of a foot.

22. A power supply assembly according to claim 1, wherein each said output connection comprises a plugging lug, and a current conductor, associated with said output connection, comprises a latching plugging connection.

23. A power supply assembly according to claim 1, wherein each said input connection comprises a contact plate having a hole, and a current conductor, associated with said input connection, has an eyelet, which can be fixed to said input connection by means of a screw.

24. A power supply assembly according to claim 1, wherein contact can be made with two or more adjacent output connections of said at least one power breaker by means of a multipole plug.

25. An electrical device comprising the power supply assembly of claim 1.

26. An electrical device according to claim 25, wherein said electrical device is selected from the group consisting of a heater, a lawnmower and an electric vehicle.

* * * * *